US005209495A

United States Patent [19]

Palmour

[11] Patent Number: 5,209,495

[45] Date of Patent: May 11, 1993

[54] RECIPROCATING ROD PUMP SEAL ASSEMBLY

[76] Inventor: Harold H. Palmour, Rte. 8, Box 428, Livingston, Tex. 77351

[21] Appl. No.: 849,988

[22] Filed: Mar. 12, 1992

Related U.S. Application Data

[63] Continuation-in-part of Ser. No. 577,018, Sep. 4, 1990, abandoned.

[51] Int. Cl.[5] ..... F16J 15/32

[52] U.S. Cl. ..... 277/3; 277/15; 277/17; 277/27

[58] Field of Search ..... 277/3, 15, 27, 17-21, 277/28, 58, 59

[56] References Cited

U.S. PATENT DOCUMENTS

| | | | |
|---|---|---|---|
| 2,155,628 | 4/1939 | Williams | 277/17 |
| 2,655,628 | 10/1953 | Pratt | 318/627 |
| 3,161,413 | 12/1964 | Audemar | 277/15 |
| 3,259,390 | 7/1966 | Sanford | 277/3 |
| 3,602,613 | 8/1971 | Gunther | 277/15 |
| 3,810,634 | 5/1974 | Hakansson | 277/3 |
| 4,146,237 | 3/1979 | Bergman | 277/3 |
| 4,206,928 | 6/1980 | Asano | 277/3 |
| 4,247,121 | 1/1981 | Bergman | 277/3 |
| 4,428,584 | 1/1984 | Shapiro | 277/3 |
| 4,483,141 | 11/1984 | Kobayashi | 277/3 |
| 4,623,151 | 11/1986 | Kashiwamura et al. | 277/17 |
| 4,703,835 | 11/1987 | Negrutsky | 277/3 |
| 4,769,992 | 9/1988 | Harada et al. | 277/15 |

FOREIGN PATENT DOCUMENTS

| | | | |
|---|---|---|---|
| 2833139 | 2/1979 | Fed. Rep. of Germany | 277/15 |
| 1236013 | 6/1971 | United Kingdom | 277/3 |

*Primary Examiner*—William A. Cuchlinski, Jr.
*Assistant Examiner*—Daniel G. DePumpo
*Attorney, Agent, or Firm*—Dodge, Bush, Moseley & Riddle

[57] ABSTRACT

In accordance with illustrative embodiments of the present invention, a combination stuffing box and pressure transmitter system for use with a reciprocating rod or plunger pump includes a housing that carries primary and secondary seal assemblies separated by an oil-filled chamber. A pressure transmitter transmits the pressure of the fluid being pumped to the oil in the chamber so that the secondary seal assembly operates under substantially balanced pressure conditions with little or no tendency of the pumped fluids to leak past it, while the primary seal assembly operates under optimum conditions to prevent leakage of oil having known characteristics to the environment.

22 Claims, 2 Drawing Sheets

FIG. 1
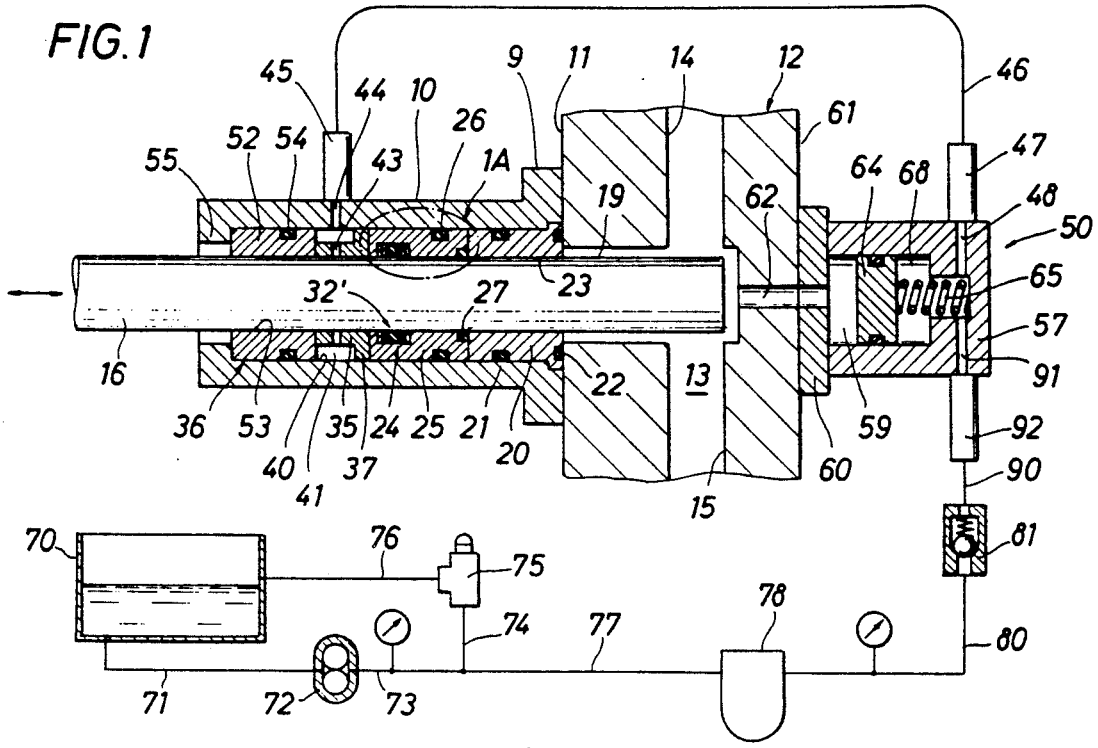
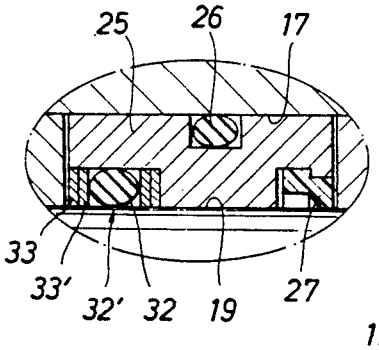
FIG. 1A
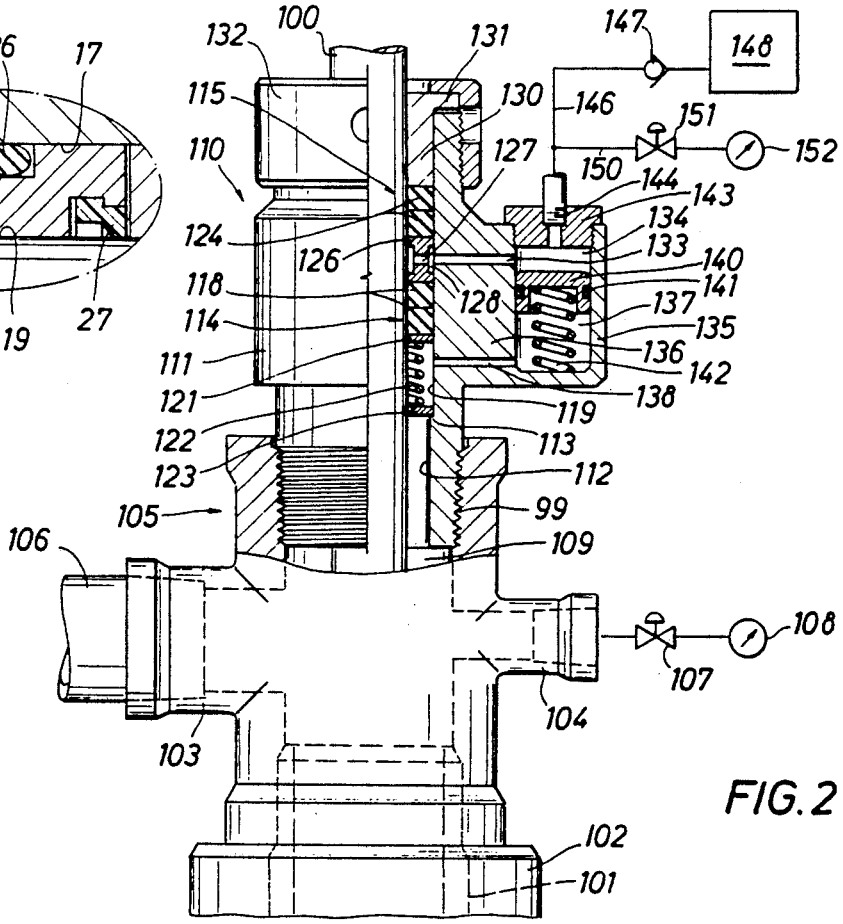
FIG. 2

RECIPROCATING ROD PUMP SEAL ASSEMBLY

CROSS-REFERENCE TO RELATED APPLICATION

This application is a continuation-in-part of U.S. application Ser. No. 577,018 filed Sep. 4, 1990, and abandoned in favor of this application.

FIELD OF THE INVENTION

This invention relates generally to a new and improved dynamic seal system for preventing leakage of pumped fluid through the clearance between a movable shaft or rod and a housing or gland through which the rod extends. More particularly, the present invention is directed to a plunger or rod pump stuffing box which includes axially spaced primary and secondary seals that are separated by an annular chamber which contains a clean lubricating oil. The pressures of the fluid being pumped act on the inner side of the secondary seal, and a pressure transmitter transmits the pressure of the fluid being pumped to the lubricating oil in the chamber in a manner such that it is applied to the outer side of the secondary seal. Thus balanced pressure conditions are achieved across the secondary seal so that the fluid being pumped does not leak into the lubricating oil chamber, and so that the primary seal can function under optimum conditions to prevent leakage to the outside since it contains a fluid having known characteristics.

BACKGROUND OF THE INVENTION

Leakage of fluid from a rod or a plunger pump to the environment is highly undesirable, particularly in the case of oil wells when the leaked fluids will contaminate the vicinity of the well, and possibly even run into streams in the area. In addition to contamination, the leakage of the oil results in loss of valuable natural resources. This problem is particularly acute where the well is on a pumping system where a polish rod reciprocates through a packing gland at the top of the production tubing in order to operate a downhole pump. Most all of such pumping systems are examined and serviced only occasionally, so that leakage can go undetected for a considerable length of time before it is discovered.

Another common source of leakage is past the packing gland of a multiplex plunger pump that is used in various hydraulic pumping systems, for example a system that is used to circulate power oil under high pressure to a hydraulically operated downhole pump, and systems such as transfer and pipeline pumps that operate on a substantially continuous basis. Hereagain, such pumps usually include a reciprocating plunger that extends into a pump chamber through a stuffing box, and operates in a manner such that the fluid being pumped is drawn in through the inlet to the chamber during reciprocation of the plunger in one direction, and is forced out through an outlet from the chamber under high pressure during reciprocation of the plunger in the opposite direction. The high pressures involved, and the occasional abrasive nature of the fluids being pumped, have made it extremely difficult to provide a leak-proof packing gland or stuffing box apparatus that will contain the pumped fluid during operation over an extended length of time.

Although not directed to the concepts of the present invention, attempts to improve the seal between a gland and a rod are shown in U.S. Pat. Nos. 2,155,628 and 3,602,613. The '628 patent illustrates a spring-loaded piston which transmits submergence pressure to an annular cavity outside a number of packing rings that are axially compressed between thrust faces and biased inward by garter springs. The cavity pressure is maintained by the action of the piston spring at a level which exceeds submergence pressure by a selected amount, so that all peripheral edges of each packing ring are extruded outward by the garter spring. In another embodiment which is disclosed in this patent as being applicable primarily to high rotary speed applications, the spring and piston cause radial inward pressure on the packing rings to exceed chamber pressure by some selected amount, so that in addition to such extrusion the rings always "hug" the rod tightly. However, this '628 patent is not pertinent to the concept of balancing fluid pressures across a secondary in a stuffing box, and employs a packing ring construction that does not lend itself to such concepts. The '613 patent discloses a seal assembly where a pair of metal seal bushings are used, and an auxiliary pump is employed to apply pressure between them in a manner such that bushing-to-rod clearances are reduced. This patent also fails to teach or to suggest the balancing, or substantially, of fluid pressures in a manner such that an unknown fluid has practically no tendency to leak past a secondary seal while a primary seal is used to contain the pressure of a known fluid.

The general object of the present invention is to provide a new and improved stuffing box and pressure transmitter combination for preventing leakage of fluid past a plunger or rod that reciprocates under pressure with respect to the gland.

Another object of the present invention is to provide a new and improved seal assembly of the type described that includes primary and secondary seals for preventing fluid leakage along the rod, and where one of these seals is subjected to balanced pressures by a transmitter that transmits pump chamber pressure to the outer side of the secondary seal to prevent movement of pumped fluids under pressure therepast.

Still another object of the present invention is to provide a new and improved seal assembly of the type described where the seal assembly includes primary and secondary seals are separated by a chamber that contains a clean lubricating oil, and where the transmitter includes piston means which transmit the pressures of the pumped fluid to the lubricating oil in the chamber in order to balance fluid pressures across the secondary seal, thereby allowing the primary seal to prevent leakage of a known fluid, i.e. the lubricating oil.

SUMMARY OF THE INVENTION

These and other objects are attained in accordance with the concepts of the present invention through the provision of a combination stuffing box and pressure transmitter assembly where the box includes a housing having a bore. A plunger or rod reciprocates with respect to the bore to perform a pumping function. The stuffing box includes axially spaced primary and secondary seal means which engage outer surfaces of the rod to inhibit fluid leakage, and the seal means are separated by an annular chamber that is filled with a clean lubricating oil so that the opposed sides of the seal means are exposed to the pressure of lubricating oil. The inner side of the secondary seal means is subjected to the pressures of the fluid being pumped. However, such pressures also are transmitted by the transmitted assembly to the lubricating oil in the chamber by means such as a floating piston, or its equivalent, so that the pressures of the lubricating oil is substantially balanced with respect to the pressures of the pumped fluid. Thus there is no substantial pressure differential which appears across the secondary seal means and which would otherwise tend to cause the pumped fluids to leak past it. The primary seal means operates under optimum conditions to prevent leakage to the outside since it has a clean lubricating oil with known characteristics on its high pressure side. If desired, what little lubricating oil that leaks past the primary seal can be collected and recirculated back to the transmitter assembly by suitable means. The present invention has application to plunger or rod pumps of various designs and applications, and to downhole pumps that are operated by a sucker rod string which reciprocates through a stuffing box at the surface, and to many other applications.

BRIEF DESCRIPTION OF THE DRAWINGS

The present invention has other objects, features, and advantages which will become more clearly apparent in connection with the following detailed description of preferred embodiment, takin in conjunction with the appended drawings in which:

FIG. 1 is an illustration of the present invention used in connection with a multiplex plunger pump;

FIG. 1a is an enlarged view of certain seals shown in FIG. 1;

FIG. 2 is an illustration of the present invention used in connection with an oil or water well pump that is actuated by a sucker rod;

DETAILED DESCRIPTION OF PREFERRED EMBODIMENTS

Figure 3:
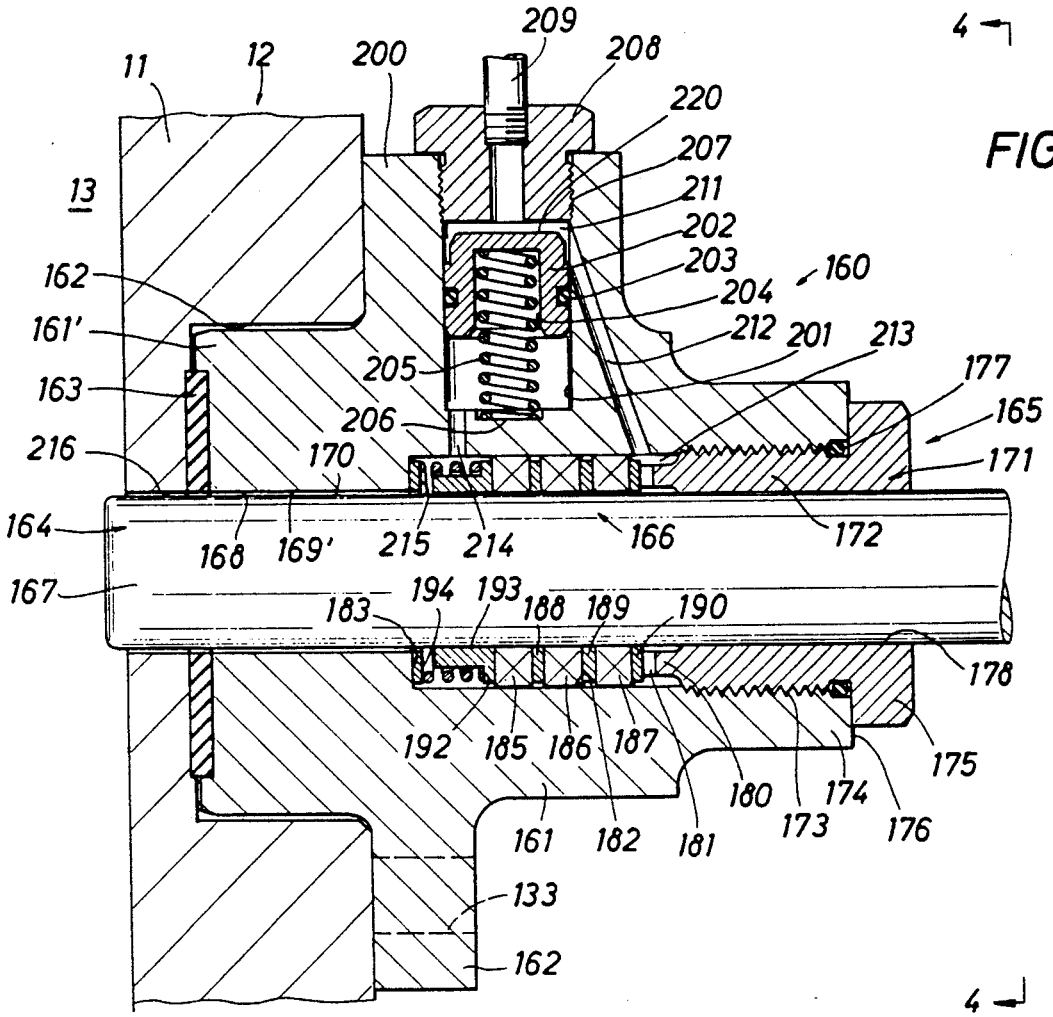
FIG. 3 is a cross-sectional view of another embodiment of the present invention.

Referring initially to FIG. 1, a packing gland and pressure transmitter system in accordance with the present invention includes a generally tubular housing 10 having a flange 9 that is secured by bolts (not shown) to the wall 11 of a pump body 12. The pump can be any reciprocating rod or plunger pump that is used, for example, to circulate working fluid during hydraulic pumping applications such as loading, pipeline and transfer pumps, as well as in well drilling operations. The pump body 12 forms a chamber 13 having an inlet passage 14 and an outlet passage 15. A rod or plunger 16 is arranged to be reciprocated with respect to the housing 10 and the chamber 13 such that working fluid is drawn into the chamber through the inlet passage 14 each time the plunger or rod 16 moves outward, and is discharged under pressure via the passage 15 each time the plunger moves inward. Of course the pump body 12 is provided with suitable check valves (not shown) which control fluid flow through the intake and discharge passages.

Primary and secondary seal assemblies indicated generally at 36 and 24 is mounted in the housing 10 adjacent the plunger 16. A metal sleeve 20 is mounted in the inner end portion of the housing 10 and carries an outer seal ring 21 and an end seal ring 22 that prevent leakage between the outer surfaces of the sleeve and the adjacent walls of the housing 10, and between the end of the sleeve of the wall 11 of the pump 12. The metal sleeve 20 has a bore 23 which fits over the outer surface 19 of the plunger 16, however the clearance is such that the pressures of the fluid being pumped can readily pass therethrough. The secondary seal assembly 24 includes another metal sleeve or bushing 25 that is mounted adjacent the outer end of the sleeve 20. As shown in enlarged FIG. 1A, the sleeve 25 carries an external seal such as an O-ring 26 that engages the inner wall 17 of the housing 10, as well as an inner seal assembly 32' which can include an O-ring 32 that engages the outer surface 19 of the plunger 16 and is provided with back-up rings 33, 33' at each end. The assembly 32' is mounted in an internal annular recess in the outer portion of the metal sleeve 25 as shown. The sleeve 25 also can have an internal recess at its inner end which carries a conventional wiper ring 27 that functions to inhibit outward movement of any debris that may move outward through the clearance between the sleeve 20 and the plunger 16. The seal assembly 32' provides a sliding seal against the outer surface 19 of the plunger 16, while the O-ring 26 provides a static seal with respect to the inner wall surface 17 of the housing 10.

The primary seal assembly 36 includes a metal sleeve 52 positioned near the outer end of the housing 10 and having a bore 53 that receives the plunger 16 with a close-tolerance, metal-to-metal sliding fit that is substantially leak-proof. Another seal ring 54 in a groove on the outside of the sleeve 52 prevents fluid leakage between the outer surface of the sleeve and the adjacent inner wall of the housing 10. The outer end of the housing 10 can be formed to provide an inwardly extending flange 55 that engages the outer end surface of the sleeve 52, or a separate cap screwed onto the housing can provide such flange. A spacer ring 35 which can have a stepped-diameter is positioned between the outer end surface of the secondary seal sleeve 25 and the inner end surface of the primary seal sleeve 52. The spacer ring 35 has an outwardly extending flange 37, and together with the inner wall surface 40 of the housing 10 defines an annular chamber or cavity 41. The lesser diameter portion of the spacer ring 35 can be provided with several radial ports 43 which extend through the wall thereof.

The pressure transmitter of the present invention, which is indicated generally at 50 in FIG. 1, includes a housing 57 having an internal bore that defines a cylinder 59. The housing 57 can be fixed to a base 60 which is secured by suitable means (not shown) to an outer wall 61 of the pump body 12. As an alternative the housing 57 and the base 60 may be made an integral part of the pump body 12. A port 62 that extends through the base 60 and the wall 61 communicates the pump cavity 13 with the cylinder 59. A floating piston 64 having an external seal ring 65 is positioned within the cylinder 59, and a coil spring 65 that reacts between the outer side of the piston and an internal end wall on the housing 57 can be used to generally center the piston in the cylinder 59. A port 48 communicates the outer portion 68 of the cylinder 59 with a connection 47 to a line 46 that leads to another connector 45 and a port 44 which lead to the annular chamber 41 between the primary and secondary seal assemblies 36 and 24.

The chamber 41, the port 44, the connector 45, and the line 46, the connector 47, the port 48 and the outer portion 68 of the transmitter cylinder 59 are all filled with a clean lubricating oil, such as standard 40 weight motor oil or the like. The port 62 subjects the floating piston 64 to pressures in the pump chamber 13, and the piston can move within the cylinder 59 to transmit such pressures through the line 46 to the annular chamber 41 so that such pressures act on the outer end surface of the sleeve member 25 and on the outer sides of the seal rings 32 and 26 of the secondary seal assembly 24, as well as on the inner end surface of the seal sleeve 52 and on the inner side of the seal ring 54. At the same time, these pressures are being transmitted to the inner end surface of the sleeve member 25 and to the inner sides of the seal rings 32 and 26 through the clearance between the metal sleeve 20 and the plunger 16. The wiper ring 27, by its nature, allows chamber pressures to be applied to the inner sides of the seal rings 26 and 32, as described. The primary seal assembly 36 thus is subjected to the difference between the pressures of a lubricating oil having known characteristics, in the chamber 41 and atmospheric pressure outside the body 10. Thus, the primary seal assembly 36 operates under essentially ideal conditions to prevent fluid leakage to the environment, whereas the secondary seal assembly 24 operates under substantially balanced-pressure conditions which dictates that there is very little, if any, tendency of the pumped fluid to be forced past it and into the oil chamber 41. In this manner the lubricating oil in the chamber 41 remains free of contaminants which can be present in the pumped fluids, and of course the wiper ring 27 catches any debris that might get past the metal sleeve 20.

For purposes of collecting and recirculating any lubricating oil that might leak past the primary seal assembly 36 during operation of the pump 12, a sump or pan 70 is located underneath the housing 10 so as to catch any drippage of the oil. The sump 70 can be connected by a line 71 to a gear-type scavenger pump 72 which circulates oil via lines 71, 73, 74, a pressure relief valve 75, and a line 76 back to the sump 70. The valve 75 can be set to operate on a differential pressure that is about 10 psi, for example, above the suction pressure of the pump 12. When the cylinder portion 68 of the pressure transmitter 50 needs make-up oil due to any leakage past the primary seal sleeve 52, a supply is fed through line 77, filter 78, line 80, a check valve 81, line 90, a connector 92 and a port 91 to the cylinder portion 68. In this manner, no lubricating oil whatsoever is wasted to the environment, and the pressure transmitter system 50 is assured of a proper volume of oil at all times.

In operation of the embodiment shown in FIG. 1, the stuffing box assembly 10 and the pressure transmitter assembly 50 are arranged as shown in the drawings and are mounted respectively on the pump body 11. Then the chamber 41 between the primary and secondary seal assemblies 36 and 24, the various connectors, lines and ports, and the outer portion 68 of the cylinder 57 are filled with lubricating oil. The check valve 81 closes outward as shown to prevent back flow of oil toward the filter 78. As the plunger 16 moves to the right in FIG. 1 to pump working fluid under pressure out the discharge passage 15, the increasing pressures are communicated by the port 62 to the transmitter cylinder 59, and thus to the inner side of the floating piston 64. The piston 64, in turn, transmits the pressures to the oil in the cylinder portion 68, where such pressure is transmitted through the line 46 to the oil in the chamber 41. As noted above, such pressures act inwardly on the outer end surface of the sleeve member 25, and also act inwardly on the inner sides of the seal rings 32 and 26. However since such increasing pressures also are transmitted to the inner end of the sleeve member 25 and to the inner sides of the seal rings 32 and 26 through the clearance space between the metal sleeve 20 and the plunger 16, no pressure differentials are developed across the secondary seal rings or the sleeve 25 during the power stroke of the plunger 16. As the plunger 16 shifts to the left in FIG. 1 during an intake stroke, the decreasing pressures in the pump chamber 13 are transmitted in the same way so that substantially balanced pressure conditions again are maintained across the components of the secondary seal assembly 24. Since the lubricating oil in the chamber 41 has known characteristics, the primary seal assembly 36 operates under optimum conditions to prevent fluid leakage of the oil to the environment. However, should there be any leakage of oil past the sleeve 52, the oil is collected in the id pan 70 and circulated back to the outer portion 68 of the transmitter cylinder 59 by the pump 72. Any impurities or debris in the lubricating oil are trapped in the filter 78.

Another embodiment of the present invention is shown in FIG. 2. Here a pumping well, typically an oil or a water well, is being produced in response to reciprocation of a polish rod 100 that is connected to a string of sucker rods which extend down inside a production tubing 101. The lower end of the sucker rod string is coupled to the piston of a pumping cylinder assembly which is mounted at the lower end of the tubing 101. Although not shown in FIG. 2, the well usually is lined with casing which has its upper end attached to a wellhead 102. The tubing 101 is suspended in a standard hanger that is positioned inside the wellhead 102, and the uppermost end of the tubing is screwed into a standard pumping tee 105. The pumping tee 105 has side outlets 103 and 104, and the outlet 103 has a flow line 106 screwed into it which leads to a storage tank or the like. The outlet 104 can be connected by a pipe nipple to a valve 107 having a pressure gauge 108 connected to its outer end, so that when the valve is opened, the pressure of the pumped fluids in the region 109 of the pumping tee 105 can be monitored.

The polish rod 100 is reciprocated through a stuffing box assembly 110 which includes a housing 111 whose lower end is screwed into the top of the pumping tee 105 at threads 99. The rod 100 is reciprocated with respect to the bore 112 of the housing 111 by any suitable means, such as a walking beam apparatus (not shown). An upwardly facing shoulder 113 in the bore 112 supports a seal assembly including a secondary seal indicated generally at 114 and a primary-seal indicated generally at 115. The secondary seal 114 includes a pair of resilient packing rings 118 which seal off the cylindrical space between the outer surface of the rod 100 and the bore 119 of the housing 111 above the shoulder 113. The lower one of the packing rings 118 is supported by a metal ring 121, a coil spring 122 and a spring retainer 123 which engages the shoulder 113. The primary seal 115 also includes a pair of resilient packing rings 124 of any suitable type, which also seal off the cylindrical space between the outer surface of the polished rod 100 and the bore wall 119. An elongated spacer ring 126 is located between the seal assemblies 114 and 115 and can have the general shape of an "I" with a plurality of radial ports 127 formed through the central wall section thereof. In this manner an annular chamber 128 is formed between the primary and secondary seal assemblies 114, 115. The seal assemblies and the spacer ring are held down by a packing gland 130, which is received in the upper end of the housing bore 119. An outward directed flange 131 on the gland 130 is captured by a nut 132 which is threaded onto the top end portion of the housing 111 as shown. The spring 122 typically is compressed during tightening of the nut 132 so that the spring exerts upward pressure on the packing rings 118.

The chamber 128 is communicated by a passage 133 with the upper portion 134 of a pressure transmitter cylinder 135. In this embodiment, the cylinder 135 is formed in a boss 136 which extends outwardly to the side of the housing 111. The lower portion 137 in the cylinder 135 is communicated by a passage 138 with the internal region 109 below the lower end of the housing 111 and below the secondary seal 114. A floating piston means 140 which carries a seal ring 141 is positioned in the cylinder 135, and is held approximately in the position shown by a coil spring 142 that has its upper end engaged in a recess in the piston 140 and its lower end resting on the bottom wall of the cylinder 135. The annular chamber 128, the port 133 and the cylinder space 134 above the piston member 140 are filled with a lubricating oil as previously described. The piston 140 functions to transmit the pressures of the pumped fluid in the region 109 to the chamber 128. If desired, the top of the cylinder 135 can be closed by a threaded fitting 143 which has a port 144 to which a lubricating oil supply line 146 is attached. The line 146 leads via an outwardly closing check valve 147 to a source 148 of lubricating oil supply in the event any make-up oil is needed. The line 146 can be connected by a tee to a branch 150 which is connected to a valve 151 and another pressure gauge 152. The gauge 152 monitors the lubricating oil pressures in the region 134 above the piston 190 and thus allows comparison of oil pressures with the pumped fluid pressures which can be shown simultaneously on the gauge 108. The port 144 also is used to inject clean lubricating oil into the cylinder space 134, the passage 133 and the chamber 128 when the system is first installed.

In operation of the embodiment shown in FIG. 2, as the polish rod 100 moves upward through the stuffing box assembly 110 to lift a volume of fluid out of the production tubing 101, the increasing pressures in the region 109 are transmitted by the passage 138 to the lower side of the floating piston 140 which transmits such pressures to the oil in the chamber 128. Here the pressures are applied to the upper side of the secondary seal assembly 114, and to the lower side of the primary seal assembly 115. Since the pressures in the region 109 also are acting upward on the lower side of the secondary seal assembly 114 through the space in which the spring 122 is located, substantially balanced pressure conditions are created across the packing elements 118 of the secondary seal assembly 114, so that there is practically no tendency for any pumped fluid to leak upwardly past these seals and into the oil chamber 128. As the polish rod 100 moves downward, balanced pressure conditions also are maintained as reduced pressures in the region 109 act upward on the lower side of the secondary seal assembly 114, and at the same time are being transmitted by the floating piston 140 to the oil in the chamber 128 whereby the same pressure acts downward on such the upper side of the secondary seal assembly. The pumping pressures are held by the primary seal 115, which prevents leakage of the oil in the chamber 128 out the top of the body 111, and which operates under optimum conditions because the oil is a clean liquid of known characteristics which is contained in a closed system.

Figure 4:
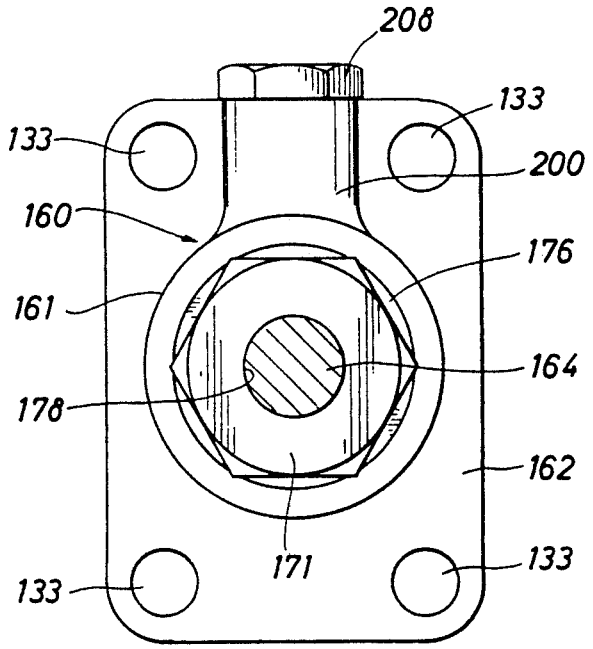
FIG. 4 is a somewhat reduced side elevation on line 4-4 of FIG. 3.

Still another embodiment of the present invention is shown in FIGS. 3 and 4 and, like the embodiment shown in FIG. 1, has application primarily to a multiplex plunger pump. Here the stuffing box assembly 160 includes a body 161 that is provided with a flange 162 having bolt holes 133 by which the flange and body can be attached to the wall 11 of a plunger pump 12 having an internal working chamber 13. The body 161 can have an inner boss 161' that fits into a cylindrical recess 162 in the outer wall of the pump 12, and a sealing gasket 163 can be positioned as shown to prevent leakage from the chamber 13 to the outside past the outer edge of the boss 161'. A rod or plunger 164 is arranged to reciprocate axially with respect to the bore of the body 161 and through a primary seal assembly indicated generally at 165 and a secondary seal assembly indicated generally at 166. The plunger 164 has an inner end portion 167 which displaces fluid under pressure out of the chamber 13 on each inward stroke. A clearance space 168 is provided between the inner bore surface 169' of the body section 161' and the adjacent external surface 170 of the plunger 164.

The primary seal assembly 165 includes a metal sleeve member 171 which is mounted on the outer side of the body 161. The sleeve member 171 has a stepped outer diameter, and the inner portion 172 thereof can be threaded at 173 to a boss 174 that forms an outer portion of the body 161. The outer portion 175 of the sleeve member 173 can be enlarged to provide a stop shoulder which butts up against the end surface 176 of the boss 174 when the threads 173 are completely tightened. A seal ring 177 can be used to prevent fluid leakage through the threads 173. The bore surface 178 of the sleeve member 172 preferably has a close-tolerance fit with respect to the outer surface 170 of the rod 164 which provides a metal-to-metal seal area that prevents any substantial leakage to the outside of the body 161. As opposed to being a threaded sleeve, the primary seal 165 can be constructed like the elements 36 and 52-54 shown in FIG. 1. In the embodiment shown in FIG. 3, a skirt 180 is formed on the inner end of the sleeve member, and the skirt has a plurality of radial ports 181 formed therein.

The secondary seal assembly 166 is mounted between an inwardly facing annular wall surface 182 of the body 161 and the outer surface 170 of the rod 164, and between an outward facing shoulder 183 on the body and the inner end of the skirt 181. The wall surface 182 extends from the inner end of the threads 173 to the shoulder 183 which is at the outer end of the clearance space 168. In this embodiment, the secondary seal assembly 166 includes a plurality of resilient packing rings 185-187 which are separated by rigid spacer rings 188 and 189. Another spacer 190 is positioned between the packing element 187 and the inner end of the skirt 180. The outer surface of each of the packing rings 185-187 sealingly engages the annular wall surface 182 of the outer bore in the body 161, while the inner surface of each packing ring sealingly engages the outer surface 170 of the rod 164. A stepped-diameter, rigid spacer member 192 has its larger end portion engaging the inner end of the packing ring 185, and can be biased against it by a coil spring 193 which reacts between such end portion and another rigid spacer ring 194 which lies against the shoulder 183. As in a previous embodiment, when the metal sleeve 171 is tightened into the threads 173, the coil spring 193 is foreshortened somewhat so that it exerts outward pressure on the packing element 185.

The pressure transmitter assembly for this embodiment includes an outwardly directed boss 200 on the body 161 which has an internal bore 201 formed therein. A piston member 202 is slidable in the bore 201 and carries a seal ring 203 which prevents fluid leakage past it. The piston member 202 can be provided with a recess 204 which receives the upper end of a coil spring 205. The inner end of the spring 205 reacts against a surface 206 at the inner end of the bore 201. A threaded opening 207 at the outer end of the boss 200 receives a plug or fitting 208 having a center-tapped and threaded hole 209. The hole 209 can be connected to a hydraulic line 210 which leads to a make-up supply of oil as shown in FIGS. 1 or 2, and to a valve and a pressure gauge like that shown in FIG. 2, so that the fluid pressure in the region 211 of the bore 201 that is above the piston member 202 can be monitored. The line 210 also can be used for initial injection of lubricating oil into the region 211. A passage or port 212 extends through the boss 200 between the region 211 and an annular chamber or cavity 213 that is formed around the skirt 181 between the inner end of the primary seal assembly 165 and the secondary seal assembly 166. Another port 214 extends between the inner end of the piston bore 201 and the region 215 adjacent the spacer ring 192. The region 215 is in open communication with the annular clearance 168 between the plunger 164 and the boss 161', as shown, as well as with the pump chamber 13 via the annular clearance 216 between the pump body 11 and the plunger.

In operation, the parts of the stuffing box and pressure transmitter assembly 160 are assembled as shown in FIGS. 3 and 4, and the body 161 is bolted to the wall 11 of the pump 12 using studs that extend through the holes 133 in the flange 162. When the studs are tightened, the gasket 163 is squeezed against a confronting surface of the wall of the pump chamber 13 to prevent fluid leakage to the outside at the inner end of the boss 161'. Lubricating oil then is injected through the port 209 and into the region 211 above the transmitter piston member 202 where the oil also fills the passage 212 and the chamber 213 between the seal assemblies 165 and 166, including the radial ports 181. After these spaces are completely filled with oil, injection is continued to cause the piston member 202 to move inward a small distance so that its top end surface 220 is spaced away from the lower end face of the fitting 208, whereby the piston is free to transmit pressure.

As the plunger 164 shifts to the left in FIG. 3, which is the power stroke, increasing pressures in the chamber 13 are communicated through the clearance spaces 216, 168, past the spacer 194, through the region 215 and the port 214 into the bore 201 below the transmitter piston 202. The piston 202 transmits such pressures to the lubricating oil in the region 211 above it, and thus to the oil filling the passage 212 and the chamber 213 between the primary and secondary seal assemblies 165 and 166. The pressures in the chamber 213 act inward on the secondary seal assembly 166 over a transverse cross-sectional area that is defined by the difference in the areas bounded by the inner wall surface 182 of the body 161 and the outer surface 170 of the rod 164. At the same time, such pressures are present in the region 215 at the inner end of the secondary seal assembly 166, where they act outward on the same transverse cross-sectional area so that such pressures are balanced. During movement of the plunger 164 to the right in FIG. 3, reduced pressures in the pump chamber 13 are transmitted and applied to such areas in the same manner. Thus the pressure forces are always substantially balanced across the packing elements 185–187 of the secondary seal assembly 166, so that there is very little, if any, tendency of working fluid in the pump chamber 13 to leak therepast and contaminate the lubricating oil in the chamber 213. The primary seal sleeve 171 provides a metal-to-metal sealing action against the outer surface 170 of the rod 164 to prevent leakage of the lubricating oil out of the cavity 213 to the environment. Thus the primary seal assembly 165 operates under optimum conditions since it is containing a clean lubricating oil of known characteristics.

Where a balance of pressures is desired, as described above, then a spring 205 is selected which has a relaxed length such that it allows the outer end 220 of the piston member 202 to be located a small distance below the inner face of the fitting 208. In this case the spring 205 simply maintains or centers the piston 202 in this initial position during operation. On the other hand, if a small differential pressure in favor of the chamber 213 over the pressure in the pump chamber 13 is considered to be desirable, a spring 205 is used which has a relaxed length such that it holds the piston 202 up against the fitting 208 with a low bias force prior to oil filling. Then after oil filling is substantially complete, a small additional volume is injected which forces the piston 202 to travel downward a short distance against the bias of the spring 205. Under these circumstances the spring 205, having been foreshortened somewhat, will create a low positive pressure differential in favor of the oil in the chamber 213. This pressure condition can be used to ensure that if there is any leakage past the secondary seal assembly 166, it will be of the clean lubricating oil into the pump chamber 13, rather than vice versa.

It now will be recognized that new and improved stuffing box and pressure transmitter assemblies have been disclosed which accomplish each of the objectives, and which have all the features and advantages of, the present invention. Certain changes or modifications may be made in the disclosed embodiments without departing from the inventive concepts involved. For example, a diaphragm, or a disc having opposed lip seals, could be used as a pressure transmitter instead of the floating piston as disclosed. Any multiplex plunger pump already in service, as well as the typical stuffing boxes used on pumping wells, can be modified with retrofit packages to incorporate the present invention. Thus, it is the aim of the appended claims to cover all such modifications and changes falling within the true spirit and scope of the present invention.

What is claimed is:

1. An assembly for use in sealing against fluid leakage along the plunger or rod of a pumping apparatus having intake and discharge passages and valve means for controlling the direction of the flow of fluids through said passages, said rod reciprocating axially within a body during pump strokes, comprising: primary seal means in said body engaging said rod to prevent fluid leakage; secondary seal means in said body axially spaced with respect to said primary seal means and engaging said rod to prevent fluid leakage, said secondary seal means being subject on one side to the pressure of a fluid being pumped; chamber means between said primary and secondary seal means, said chamber means being filled with a lubricating oil so that secondary seal means is subject on its other side to the pressure of the lubricating oil; and pressure transmitter means for transmitting the pressure of fluids in said body between said valve means to said lubricating oil to substantially equalize the pressures across said secondary seal means to thereby prevent leakage into said cavity of said fluid during pumping.

2. The assembly of claim 1 wherein said pressure transmitter means includes a housing that defines a bore; and piston means movable in said bore and sealed with respect thereto, one side of said piston means being subject to the pressure of the fluid being pumped and the other side of said piston means being subject to the pressure of said lubricating oil, whereby said piston means transmits the pressures of the pumped fluid to said lubricating oil.

3. The assembly of claim 1 wherein said primary seal means includes a first sleeve having an internal bore surface that is dimensioned to provide metal-to-metal sealing contact with external surfaces of said rod to prevent leakage of said lubricating oil out of said chamber means.

4. The assembly of claim 3 wherein said secondary seal means includes a second sleeve, and first co-engageable means on said second sleeve and said external surfaces of said rod for preventing fluid leakage therepast.

5. The assembly of claim 4 wherein said secondary seal means further includes second co-engageable means on said second sleeve and said body for preventing fluid leakage therepast.

6. The assembly of claim 3 wherein said secondary seal means includes a plurality of resilient seal rings engaged between said body and said external surfaces of said rod.

7. The assembly of claim 6 wherein said secondary seal means further includes rigid spacer rings between adjacent ones of said resilient seal rings.

8. A stuffing box and pressure transmitter assembly for use in preventing fluid leakage along the rod and to the outside of a reciprocating plunger type pump, comprising: a body having a pump chamber; an inlet to said pump chamber and first check valve means for allowing only inward flow of fluid to said chamber; an outlet from said pump chamber and second check valve means for allowing only outward flow of fluid from said chamber; said rod extending into said chamber and adapted to draw fluid into said chamber via said inlet and first check valve means during movement in one axial direction and to displace fluid from said chamber under pressure via said outlet and second check valve means during movement in the opposite axial direction; a housing mounted on said body and having an outer end, said rod extending from the outside of said housing therethrough and into said chamber; primary seal means between said housing and said rod located adjacent said outer end of said housing; secondary seal means between said housing and said rod located between said primary seal means and said body; an annular cavity formed within said housing between said primary and secondary seal means, said cavity being filled with a lubricating oil; and pressure transmitter means for transmitting the pressures in said pump chamber between said first and second check valve means during movement of said rod in each of said axial directions to said lubricating oil in said cavity to substantially equalize the pressures on opposite sides of said secondary seal means and thereby prevent leakage of fluid from said pump chamber into said cavity and contamination of said lubricating oil thereby, while allowing pressure differentials to exist across said primary seal means while it acts to contain said lubricating oil within said cavity.

9. The assembly of claim 8 wherein said pressure transmitter means includes a second housing mounted on said body, said second housing an internal cylindrical bore; a floating piston mounted in said bore, one side of said piston being subject to the pressures in said pump chamber and the outer side thereof being subject to the pressure of said lubricating oil, whereby said piston transmits the pressures in said pump chamber to said lubricating oil.

10. The assembly of claim 9 further including spring means tending to position said piston means in a selected initial position in said bore.

11. The assembly of claim 8 wherein said pressure transmitter means includes cylinder means in said housing; a floating piston in said cylinder means, one side of said piston being subject to the pressures of fluids in said pump chamber and the other side of said piston means being subject to the pressures of said lubricating oil, whereby said piston transmits the pressures in said pump chamber to said lubricating oil.

12. The assembly of claim 11 further including spring engaging said one side of said piston means and tending to maintain said piston mens in a selected initial position in said bore.

13. The assembly of claim 11 further including spring means engaging said one side of said piston with a bias force that creates a low, relatively positive pressure differential across said secondary seal means in favor of said cavity means.

14. The assembly of claim 1 further including means for circulating any lubricating oil that leaks past said primary seal means to said pressure transmitter means.

15. An assembly for use in sealing against fluid leakage along the rod of a pumping apparatus of the like that operates to discharge fluid through an outlet check valve that comes in through an inlet check valve, said rod reciprocating axially within a body during pump strokes, comprising: primary seal means in said body engaging said rod to prevent fluid leakage out of said body; secondary seal means in said body axially spaced with respect to said primary seal means and engaging said rod to prevent fluid leakage, said secondary seal means being mounted in an elongated cylindrical region that is outlined in part by an inwardly facing annular surface on said body and in part by an external surface of said rod; means for subjecting one side of said secondary seal means to the pressure of fluid being pumped; cavity mens being formed between said primary and secondary seal means, said cavity means being filled with a lubricating oil so that the other side of said secondary seal means is subject to the pressure of lubricating oil; and transmitter means for transmitting the pressure of said fluid between said inlet and outlet check valves to said lubricating oil to thereby substantially equalize the pressures acting across said secondary seal means to prevent leakage of said fluid being pumped into said cavity means and for applying the pressure of said fluid to said primary seal means.

16. The assembly of claim 15 wherein said secondary seal means includes a first sleeve member mounted in said cylindrical region, inner seal means for preventing fluid leakage between said sleeve member and said rod, and outer seal means for preventing fluid leaking between said sleeve member and said inwardly annular surface.

17. The assembly of claim 15 wherein said secondary seal means comprises a plurality of resilient packing rings each having an internal bore surface that engages said external surface of said rod and an outer surface that engages said inwardly facing surface on said body.

18. The assembly of claim 16 wherein said primary seal means includes a second sleeve member mounted in said cylindrical region and having an internal bore that is sized to provide a close tolerance metal-to-metal fit against said extended surface of said rod.

19. The assembly of claim 15 further including spacer means for providing an axial separation between said primary and secondary seal means.

20. The assembly of claim 15 wherein said body has a cylinder formed therein; said pressure transmitting means comprising piston means in said and dividing said cylinder into first and second regions; first passage means for communicating one of said regions with the pressure of fluids between said inlet and outlet outer check valve means; and second passage means for communicating the other of said regions with said cavity means, said piston means and said first and second passage means operating to provide substantially balanced pressures across said secondary seal means.

21. The assembly of claim 20 further including spring means in one of said regions engaging said piston means and tending to hold said spring means in a selected position in said cylinder.

22. The assembly of claim 20 further including spring means in one of said regions and reacting against said piston means with a force that creates a low differential pressure across said secondary seal means in favor of said cavity means.

* * * * *